US012781601B2

(12) United States Patent
Al-Qasim et al.

(10) Patent No.: US 12,781,601 B2
(45) Date of Patent: Nov. 3, 2026

(54) METHOD FOR CO2 SEQUESTRATION MEASUREMENT AND QUANTIFICATION

(71) Applicant: SAUDI ARABIAN OIL COMPANY, Dhahran (SA)

(72) Inventors: Abdulaziz S. Al-Qasim, Dammam (SA); Sunil Kokal, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 1072 days.

(21) Appl. No.: 17/658,507

(22) Filed: Apr. 8, 2022

(65) Prior Publication Data

US 2023/0323755 A1 Oct. 12, 2023

(51) Int. Cl.
*E21B 41/00* (2006.01)

(52) U.S. Cl.
CPC ..... *E21B 41/0064* (2013.01)

(58) Field of Classification Search
CPC ..... E21B 41/0064
See application file for complete search history.

(56) References Cited

U.S. PATENT DOCUMENTS 1,754,208 A * 4/1930 Bradley ..... C01D 1/22 423/183
7,090,013 B2 8/2006 Wellington
7,704,746 B1 4/2010 White et al.
8,256,992 B2 * 9/2012 Dickinson, III ..... E21B 43/305 405/129.1

(Continued)

FOREIGN PATENT DOCUMENTS

CA 2751209 C 8/2018
CN 1062949 A * 7/1992 ..... C09K 8/50

(Continued)

OTHER PUBLICATIONS

M. de Figueiredo "Greenhouse Gas Reporting for Geologic Sequestration of Carbon Dioxide" , pp. 1-3; Carbon Management technology Conference (Year: 2012).*

(Continued)

*Primary Examiner* — Andrew Schechter
*Assistant Examiner* — Kaleria Knox
(74) *Attorney, Agent, or Firm* — Osha Bergman Watanabe & Burton LLP

(57) ABSTRACT

A illustrative process for quantifying CO2 sequestration within a reservoir includes, among other things, measuring a cumulative amount of CO2 injected into a reservoir via injection wells and at a CO2 storage plant, measuring the cumulative amount of CO2 produced via production wells and at a processing plant, estimating a cumulative amount of CO2 migrated from a reservoir based on measured CO2 via observations wells, and calculating a net amount of CO2 remaining in the reservoir based on the cumulative amount of CO2 injected, CO2 produced, and the CO2 that has migrated. An illustrative CO2 quantifying and sequestration system includes, among other things, injection wells, production wells, observation wells, measurement devices for measuring an amount of CO2 injected, observed and produced, and a measurement collection and analysis system for receiving signals from the measurement devices and for estimating an amount of CO2 sequestered within the reservoir.

29 Claims, 3 Drawing Sheets

(56) References Cited

U.S. PATENT DOCUMENTS

| | | | | |
|---|---|---|---|---|
| 8,875,789 | B2 | 11/2014 | Kaminsky et al. | |
| 9,205,375 | B2 | 12/2015 | Jones et al. | |
| 9,816,972 | B2 | 11/2017 | Romanak et al. | |
| 10,138,715 | B2 | 11/2018 | Adebayo et al. | |
| 2002/0013687 | A1 | 1/2002 | Ortoleva | |
| 2002/0027001 | A1* | 3/2002 | Wellington | E21B 36/04 166/59 |
| 2002/0043620 | A1* | 4/2002 | Tchakarov | G01N 21/3504 250/269.1 |
| 2004/0200618 | A1 | 10/2004 | Piekenbrock | |
| 2011/0066380 | A1 | 3/2011 | Hager et al. | |
| 2013/0119677 | A1* | 5/2013 | Taylor | F02C 3/22 290/1 R |
| 2014/0169131 | A1* | 6/2014 | Sinha | G01V 1/40 367/31 |
| 2015/0185062 | A1* | 7/2015 | Ahmad | G01F 15/08 73/861.04 |
| 2016/0161630 | A1* | 6/2016 | Badri | E21B 49/008 324/303 |
| 2020/0284945 | A1 | 9/2020 | Khan et al. | |
| 2023/0038447 | A1* | 2/2023 | Hasan | C01F 5/24 |
| 2023/0064753 | A1* | 3/2023 | Ayirala | E21B 43/164 |

FOREIGN PATENT DOCUMENTS

| | | | | |
|---|---|---|---|---|
| CN | 204941491 | U * | 1/2016 | |
| CN | 107083943 | B * | 10/2019 | E21B 43/164 |
| CN | 210460634 | U * | 5/2020 | |
| CN | 112800592 | A | 5/2021 | |
| CN | 113153241 | A * | 7/2021 | |
| CN | 116256282 | A * | 6/2023 | G06Q 10/02 |
| EP | 3981459 | A1 * | 4/2022 | A61M 16/20 |
| JP | 2008297221 | A * | 12/2008 | |
| JP | 2009198490 | A * | 9/2009 | |
| JP | 2011031154 | A * | 2/2011 | |
| NO | 334054 | B1 * | 11/2013 | E21B 43/34 |

OTHER PUBLICATIONS

"Carbon balance of CO2-EOR for NCNO classification" Vanessa Nunez-Lopez. Energy Procedioa 114(2017) 6597-6603; 13the International Conference on Greenhouse Gas Control Technologies, GHGT-13, 14-18 (Year: 2017).*

Cuemath, "Percentage", pp. 1-11, Mar. 14, 2022 (Year: 2022).*

Hao, Yanjun, et al., "A feasibility study of CO2 geologic sequestration integrating reservoir simulation, rock-physics theory, and seismic modeling", Geophysics, Society of Exploration Geophysicists, vol. 81, No. 5, Sep.-Oct. 2016, pp. M71-M82 (12 pages).

Mukhopadhyay, Pradip Kumar and Vladimir Alvarado, "Time-lapse monitoring carbon sequestrated brine aquifers—a feasibility study", SEG Denver 2010 Annual Meeting, SEG, 2010, pp. 1630-1634 (5 pages).

Zhang, Rui, et al., "Time-lapse pre-stack seismic data registration and inversion for CO2 sequestration study at Cranfield", Geophysical Prospecting, European Association of Geoscientists & Engineers, 2014, pp. 1-12 (12 pages).

International Search Report and Written Opinion Issued in Corresponding Application No. PCT/US2023/017915, mailed Jul. 7, 2023, 17 pages.

M. de Figueiredo et al., "Greenhouse Gas Reporting for Geologic Sequestration of Carbon Dioxide," Carbon Management Technology, Feb. 7, 2012, XP093058178, pp. 1-3, , 2 pages.

Nunez-Lopez et al., "Carbon balance of CO2-EOR for NCNO classification," Energy Procedia, vol. 114, Aug. 18, 2017, pp. 6597-6603, 4 pages.

Vermeul et al., "An overview of the monitoring program design for the FutureGen 2.0 CO2 storage site," International Journal of Greenhouse Gas Control, vol. 51, Jun. 8, 2016, pp. 193-206, 7 pages.

* cited by examiner

METHOD FOR CO2 SEQUESTRATION MEASUREMENT AND QUANTIFICATION

FIELD OF THE DISCLOSURE

Embodiments of the present disclosure generally relate to measuring and quantifying carbon dioxide sequestration in a reservoir.

BACKGROUND

Increased emissions of greenhouse gases are a major concern because they cause global warming and other unwanted changes in weather patterns. These changes have had a significant impact the Earth's fragile ecosystem and have been linked to the melting of the ice caps, droughts, and increased severity of storms. The role of carbon dioxide (CO2) in global warming is of particular interest because CO2 is classified as a major greenhouse gas and CO2 is continuously emitted into the atmosphere because of the exploitation of fossil fuels.

Efforts to control and decrease CO2 emissions have led to developments in carbon capture utilization and storage (CCUS) technologies. CCUS methods have emerged as a promising solution for capturing and storing CO2 emissions in oil and gas reservoirs. Ultimately, CO2 derived substances may be stored indefinitely by CO2 sequestration. An important aspect of CCUS methods is monitoring, measuring, and quantifying CO2 sequestration.

SUMMARY OF THE CLAIMED EMBODIMENTS

In one aspect, embodiments disclosed herein relate to a process for quantifying CO2 sequestration within a reservoir by measuring a cumulative amount of CO2 injected into a reservoir via injection wells, CO2 produced from the reservoir via production wells, and by estimating the cumulative amount of CO2 migrated from a reservoir based on CO2 measured at observations wells. Further, a net amount of CO2 remaining in the reservoir may be calculated based on the cumulative amount of CO2 injected, produced, and migrated.

In another aspect, the process for quantifying CO2 sequestration within a reservoir may also include additional measurements from several sources including, a CO2 storage plant, a mixing process for preparing enhanced oil recovery fluids or foam and recovered gas recovered from a mud gas separator. The cumulative amount of CO2 may also be measured from the flow rate of an injected CO2 mixture both uphole or downhole within the injection well, from the composition of CO2 in the mixture, and from calculating a flow rate of CO2 injected and a total gas stream where the composition of the gas stream may be analyzed to calculate the CO2 rate.

Similarly, the cumulative amount of CO2 recovered or produced from the reservoir may be measured from several sources including a gas oil separation plant, the flow rate of a CO2 mixture uphole or downhole within the production well, analyzing the a composition of CO2 in the mixture, and by calculating the flow rate of produced CO2.

To give a more accurate measurement, the cumulative amount of CO2 produced may also be measured from the total gas stream, where the composition of the gas stream is analyzed, and the CO2 rate is calculated. The cumulative amount of CO2 produced may also be measured by analyzing the composition of a multiphase stream and calculating the CO2 rate. The measurements may be verified via spot analysis or a proxy of the cumulative oil and gas produced.

The cumulative amount of CO2 migrated may be estimated by measuring an amount of CO2 recovered from the observation well, by measuring the flow rate of the CO2 mixture uphole or downhole within the observation well, analyzing the a composition of CO2 in the mixture and calculating a flow rate of CO2 produced and by analyzing the composition of a gas stream, and calculating the CO2 rate. Also, tracers may be introduced via the injection well and produced via the observation well and measured.

Calculating a net amount of CO2 remaining in the reservoir may be quantified by the cumulative amount of CO2 injected, the cumulative amount of CO2 produced, and the cumulative amount of CO2 migrated; and using the calculated net amount of CO2 remaining to estimate CO2 migration percentage or CO2 sequestration percentage during an enhanced oil recovery process or over a lifetime of a well.

In another aspect, embodiments disclosed herein relate to a CO2 quantifying and sequestration system that may include injection wells; production wells, observation wells and measurement devices associated with the injection wells, production wells; and observation wells. The system may further include a measurement collection and analysis system for receiving signals from each of the measurement devices and for estimating an amount of CO2 sequestered within the reservoir. The cumulative amount of CO2 measurements may be based on real time measurements, on an average or spot data over given time intervals.

Other aspects and advantages will be apparent from the following description and the appended claims.

Figure 1:
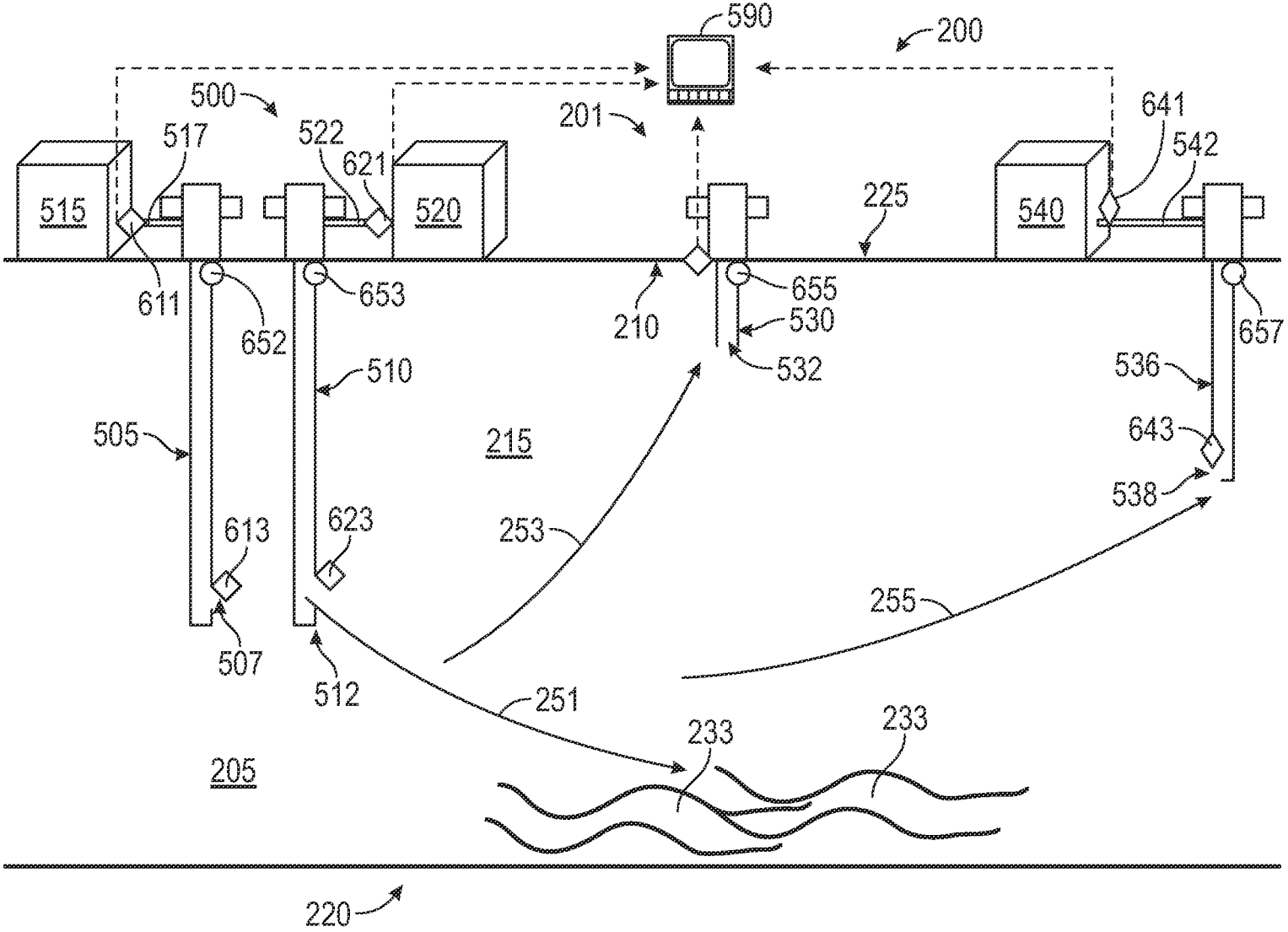
FIG. 1 illustrates a system for monitoring, measuring and quantifying CO2 sequestration according to one or more embodiments.

While the subject matter disclosed herein is susceptible to various modifications and alternative forms, specific embodiments thereof have been shown by way of example in the drawings and are herein described in detail. It should be understood, however, that the description herein of specific embodiments is not intended to limit the disclosed subject matter to the particular forms disclosed, but on the contrary, the intention is to cover all modifications, equivalents, and alternatives falling within the spirit and scope of the disclosed subject matter as defined by the appended claims.

Typically, down is toward or at the bottom and up is toward or at the top of the figure. "Up" and "down" are oriented relative to a local vertical direction. However, in the oil and gas industry, one or more activity may take place in deviated or horizontal wells. Therefore, one or more figure may represent an activity in vertical, approximately vertical, deviated, approximately horizontal, or horizontal wellbore configuration.

DETAILED DESCRIPTION

Carbon dioxide (CO2) is used at numerous points in the lifetime of a reservoir. CO2 may be introduced in various drilling fluids during initial drilling of a well. CO2 may be injected during secondary or tertiary oil and gas recovery efforts, such as during enhanced oil recovery (EOR) operations. For example, CO2 may be injected as a gas, liquid, or supercritical fluid, and may be used alone or in a CO2 mixture or as a foaming agent to provide the desired effects during the secondary or tertiary oil and gas recovery operations. CO2 may also accompany the produced oil and gas during the secondary and tertiary recovery efforts, as well as migrate through the formation and be emitted through the surface layers into the atmosphere. CO2 may also be introduced into depleted (abandoned or non-producing wells) for the express purpose of carbon capture and storage.

During each of these stages of a lifetime of a reservoir (drilling, primary production, secondary and tertiary recovery, and shut-in), CO2 may be trapped, stored, or sequestered by various mechanisms within a formation. Some mechanisms for CO2 trapping may include static trapping, structural trapping, stratigraphic trapping, hydrodynamic trapping, and capillary trapping. CO2 may react with various rocks or minerals, may be adsorbed onto or within pores of various rocks and minerals, or may be effectively trapped below a non-porous layer of rock, among other numerous possibilities known to one skilled in the art.

Embodiments herein are directed toward methods for accurately determining the amount of CO2 that has been stored or sequestered within a reservoir and may be used to accurately determine a cumulative (total) amount of CO2 that has been effectively stored or sequestered within a reservoir.

By definition the net amount of CO2 stored or sequestered in the reservoir is a function of time. At the beginning of CO2 injection, nearly 100% of CO2 remains in the reservoir as no breakthrough of CO2 occurs from production wells. The net amount of CO2 in the reservoir decreases over time after CO2 breaks through from production wells. Concurrently, the amount of CO2 stored or sequestered in the reservoir also increases monotonically over time.

To estimate the net amount of CO2 stored or sequestered several measurements and recordings are made. Injected CO2 is measured and recorded over time. The amount injected may be measured at a source (such as a CO2 storage plant), through an orifice meter, and also at individual injection wells. The amount of CO2 produced is also measured and recorded over time. Gas rates and the amount of CO2 may be measured from gas samples collected from the production wells. The amount of CO2 may also be estimated from the flow rate and composition of the produced formation fluids. Similarly, the amount of CO2 may be measured from a combined stream of produced formation fluids at a processing plant such as a gas oil separation plant. Additionally, migration of CO2 to the surface may be measured and recorded using observation wells or surface equipment proximate the reservoir.

Accordingly, embodiments herein provide for measurement of CO2 injection, CO2 production, and CO2 migration to accurately and reliably determine the cumulative amount of CO2 sequestered. All wells (injection, production, observation) may be equipped with appropriate measurement devices to monitor the real-time flow of CO2. Migration/emission of CO2 to the surface may be estimated based on the measurements at the observation wells or other surface equipment provided for such purposes, and the amount of CO2 that is sequestered may be accurately quantified through a material balance of the injected, produced, and migrated CO2. The cumulative measurements over time may then be used to calculate or estimate a net amount of CO2 sequestered over time.

Various illustrative embodiments of the disclosed subject matter are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another.

The present subject matter will now be described with reference to the attached figures. Various structures, systems and devices are schematically depicted in the drawings for purposes of explanation only and so as to not obscure the present disclosure with details that are well known to those skilled in the art. Nevertheless, the attached drawings are included to describe and explain illustrative examples of the present disclosure. The words and phrases used herein should be understood and interpreted to have a meaning consistent with the understanding of those words and phrases by those skilled in the relevant art. No special definition of a term or phrase, i.e., a definition that is different from the ordinary and customary meaning as understood by those skilled in the art, is intended to be implied by consistent usage of the term or phrase herein. To the extent that a term or phrase is intended to have a special meaning, i.e., a meaning other than that understood by skilled artisans, such a special definition will be expressly set forth in the specification in a definitional manner that directly and unequivocally provides the special definition for the term or phrase. With reference to the attached figures, various illustrative embodiments of the systems, devices and method disclosed herein will now be described in more detail.

FIG. 1 is a diagram that illustrates carbon measurement and quantification system in accordance with one or more embodiments. The carbon measurement and quantification system 200 includes a well environment 201 that includes a reservoir 205. Above the reservoir 205 is a fluid-impenetrable overburden 210, which is part of subsurface 215. Below the reservoir 205 is the underburden 220, which is also part of the subsurface 215. The reservoir 205 may comprise matrix materials including, but not limited to, limestone, sandstone, and shale. Other matrix materials may be unconventional, including, but not limited to, marble, granite, or basalt. The well environment 201 also includes a surface 225 representing the surface of the Earth, and a subsurface 215 below the surface 225. Traversing through subsurface 215 environment is a portion of the well injection system 500, which is part of the well environment 201.

The well environment 201 includes a well injection system 500 that includes a water injection well 505. A bottomhole 507 of the water injection well 505 is positioned proximate to the underburden 220 but within the reservoir 205. In one or more embodiments, the underburden 220 is porous and permits water migration. The water injection well 505 may traverse into the underburden 220 and the bottomhole 507 of the water injection well 505 may be positioned in the underburden 220. In one or more embodiments of the carbon measurement and quantification system 200, the well environment 201 includes two or more water injection wells 505. Water may be stored on the surface 225 in a water injection plant 515. The water in the water injection plant 515 may pass through a water flow line 517 and introduced into the reservoir 205 from the water injection well 505.

The amount of water introduced into the reservoir may be measured at the water injection plant 515 by a device 611 measuring the flow rate of the water entering the water flowline 517. In one or more embodiments, an orifice meter may be used to measure the water entering the water flowline 517 from the water injection plant 515. The amount of water introduced into the reservoir may also be measured in the subsurface 215. A device 613 measuring the flow rate of the water may be located downhole near the bottomhole 507 of the water injection well 505. In one or more embodiments, Coriolis meters or ultrasonic meters may be used to measure the water entering the reservoir near the bottomhole 507 of the water injection well 505. The amount of water entering the reservoir from the injection well 505 may be controlled by a choke valve 652.

The well injection system 500 includes a CO2 injection well 510. A bottomhole of the CO2 injection well 510 is positioned proximate to the underburden 220 but within the reservoir 205. In one or more embodiments, the underburden 220 is porous and permits CO2 migration. The CO2 injection well 510 may transverse into the underburden 220 and the bottomhole 512 of the CO2 injection well 510 may be positioned in the underburden 220. In one or more embodiments of the carbon measurement and quantification system 200, the well environment 201 includes two or more CO2 injection wells 510.

CO2 may be stored on the surface 225 in a CO2 storage plant 520. CO2 in the CO2 storage plant 520 may pass through a CO2 flow line 522 and introduced into the reservoir 205 from a CO2 injection well 510. In one or more embodiments, the CO2 in a CO2 storage plant 520 and water in a water injection plant 515 may be injected from the same injection well. The stored CO2 may be in the state of a gas, a liquid, or a supercritical fluid. However, CO2 has very low density in a gaseous state compared to the density of formation fluids, such as brine and hydrocarbons. The very low density increases the upward mobility of the CO2. In contrast, both liquid and supercritical CO2 have higher densities than CO2 gas. The densities of liquid and supercritical CO2 are much closer to the densities of formation fluids in the reservoir. The similar density of the liquid and supercritical CO2 with respect to the formation fluids reduces the upward mobility of CO2. Even though this method can use CO2 in all states, the denser phases of CO2, whether liquid or supercritical, are preferred because of the desired reduction in upward mobility.

In one or more embodiments the CO2 may contain other molecules or compounds composing a CO2 mixture. The CO2 may contain tracer molecules (tracers). In one or more embodiments, tracers may be injected into the reservoir. A tracer is a chemical or other material placed in fluids injected into a well and later detected to infer information about the reservoir or movement of the fluids in a reservoir. Tracers are also used to detect leakage of CO2 into the surface and to determine CO2 leakage rates from the overburden 210 into surface 225. Those having skill in the art would appreciate that several types of tracers may be used in reservoirs including but not limited to gas tracers and water tracers.

Gas tracers may include but are not limited to radioactive tracers such as tritium, tritiated methane, tritiated ethane and tritiated butane. Gas tracers may also include but are not limited to non-radioactive tracers such as perfluorodimethylcyclobutane (PDMCB), Perfluoromethylcyclohexane (PMCH) and perfluoromethylcyclopentane (PMCP). Water tracers may include but are not limited to chemical tracers, radioactive isotope tracers such as Sulphur-35, Cobalt-57, and Iodine-132, or isotags such as halo-acid. Chemical tracers are a diverse group and may include but are not limited to thiocyanates such as ammonium thiocyanate (NH4CNS) and potassium thiocyanate (KCNS), nitrates such as ammonium nitrate (NH4NO3), sodium nitrate (NaNO3) and potassium nitrate (KNO3), halides such as sodium iodide (NaI), sodium chloride (NaCl) and Sodium bromide (NaBr), alcohols such as methanol, ethanol and propanol, ethers such as methyl acetate and ethyl acetate, dyes such as resorcinolphthalein, rhodamine, fluorinated acids such as 4-fluorobenzoic acid or rare earth elements such as lanthanum (La), Cerium (Ce), and Praseodymium (Pr).

A known amount of tracers may be stored and added to a known amount of CO2 at the CO2 storage plant 520. Tracers mixed with the CO2 may pass through the CO2 flow line 522 and introduced into the reservoir 205 from the CO2 injection well 510. Optionally, tracers may be introduced into the reservoir 205 via a pump through valves located in the wellhead.

The amount of CO2 introduced into the reservoir may be measured uphole at the CO2 storage plant 520 by a device 621 measuring the flow rate of CO2 or CO2 mixture entering the CO2 flowline 522. In one or more embodiments, an orifice meter may be used to measure the CO2 entering the CO2 flowline 522 from the CO2 storage plant 520. The amount of CO2 introduced into the reservoir may also be measured downhole in the subsurface 215. A device 623 measuring the flow rate of the CO2 may be located downhole near the bottomhole 512 of the CO2 injection well 510. In one or more embodiments, Coriolis meters or ultrasonic meters may be used to measure the CO2 entering the reservoir near the bottomhole 512 of the CO2 injection well 510. The amount of CO2 entering the reservoir from the CO2 injection well 510 may be controlled by a choke valve 653 that may limit CO2 introduced into the reservoir. In one or more embodiments, the well environment 201 includes a mud gas separator where CO2 may be measured.

In one or more embodiments the CO2 is introduced into an oil and gas reservoir as part of enhanced oil and gas recovery (EOR). In one or more embodiments, the CO2 is introduced into an oil and gas reservoir as part of drilling operations. The introduction of the CO2 is not so limited to be introduced into merely hydrocarbon-bearing formations, such as oil and gas reservoirs. The CO2 may also be introduced into depleted oil and gas reservoirs, saline aquifers, or basaltic formations, and unconventional reservoirs, such as coal beds and fractured or tight formations.

The introduced CO2 traverses into a reservoir 205 from the CO2 injection well bottomhole 512 (see arrow 251), as shown in FIG. 1. Some of the introduced CO2 traversing in the reservoir 205 may be sequestered 233 in the reservoir 205; however, some of the CO2 will not be sequestered or may require additional time for CO2 sequestration. Several factors affect the efficiency of CO2 sequestration.

The CO2 sequestration efficiency is mainly due to the density of CO2 compared to other fluids found in a reservoir, such as brine and residual hydrocarbons. The low specific gravity of CO2 may cause upward migration of CO2 (see arrows 253 and 255) and pooling at to the top of the reservoir 205, also known as "gravity override". At the boundary of the interface between the reservoir and the overburden 210, the CO2 may collect as a layer of a separated yet continuous fluid phase within the reservoir. This near-homogenous layer of CO2 fluid makes it difficult for CO2 to dissolve into other fluids in the formation or to react with the formation material and chemically convert into an inert substance.

During introduction of CO2, the efficiency of the CO2 trapped within the reservoir is also reduced by an effect known as viscous fingering. Viscous fingering occurs because the viscosity of the formation fluids in a reservoir are greater than the viscosity of the introduced CO2. The difference in the viscosities of the CO2 and the formation fluids causes a condition where the interface of two liquids bypasses sections of the reservoir as well as fluids contained therein as the introduced CO2 moves inward, creating an uneven, or fingered, profile. Viscous fingering may cause CO2 to bypass much of the pore space of the reservoir, thereby reducing the total volume utilized for sequestration.

The well environment 201 includes an observation well 530. A bottomhole 532 of the observation well 530 may be positioned downhole proximate to the overburden 210 but within the reservoir 205. An observation well may be used to measure the migration or movement of CO2 through the reservoir 205. In one or more embodiments of the carbon measurement and quantification system 200, the well environment 201 includes two or more observation wells 530. In one or more embodiments, the bottomhole 532 of an observation well 530 may be closer to the overburden 210 compared to the bottomhole 512 of a CO2 injection well 510, the bottomhole 507 of the water injection well 505 or bottomhole 538 of the production well 536 in the subsurface 215. In one or more embodiments, the bottomhole 532 of an observation well 530 may be closer to the overburden 210 compared to bottomhole of other observation wells in the subsurface 215. For example, some observation wells may have a depth of around 2500 meters and some observation wells may have a depth of around 100 meters or less.

In one or more embodiments, Coriolis meters or ultrasonic meters may be used to measure the gas entering the observation well 530. The amount of gas entering the observation well 530 may be controlled by a choke valve 655 that may limit the gas flow from the reservoir. In one or more embodiments, to measure the movement of CO2 (see arrow 253), an observation well 530 may be used to collect tracers that were mixed and injected with CO2. Tracers may be collected and measured at the surface 225 or in the subsurface 215. In one or more embodiments, gas chromatography may be used to measure tracers.

In one or more embodiments, CO2 leakage from the overburden 210 into surface 225 may be measured. In one or more embodiments, CO2 leakage may be measured using sensors such as a CO2 sniffer. A CO2 sniffer may be configured to manually or periodically measure CO2. In one or more embodiments, CO2 leakage or tracers may be measured using an eddy covariance tower. A CO2 eddy covariance tower may be configured to allow real time measurements (see below).

The well environment 201 includes a recovery or production well 536. In one or more embodiments a production well 536 is used to recover oil and gas from a hydrocarbon containing reservoir as part of enhanced oil recovery (EOR). In one or more embodiments a reservoir may be a depleted reservoir and may already have had productive hydrocarbons extracted. In depleted reservoirs, the carbon measurement and quantification system 200 may be utilized for sequestration of CO2 and not hydrocarbon exploitation.

The production well 536 may be used to collect gas and measure the amount of CO2 contained within the produced formation fluids. A bottomhole 538 of the production well 536 is positioned downhole proximate to the overburden 210 but within the reservoir 205. The production well 536 is fluidly connected by a flowline 542 to a processing plant 540. In one or more embodiment, the processing plant may be a gas oil separation plant (GOSP). In one or more embodiments of the carbon measurement and quantification system 200, the well environment 201 includes two or more production wells 536.

The amount of CO2 produced form the reservoir may be measured uphole at the processing plant 540 by a device 641 measuring the amount of the CO2 produced with the oil and gas entering the flowline 542 from the production well 536. In one or more embodiments, an orifice meter may be used to measure the CO2 containing oil and gas entering the processing plant 540. The amount of CO2 produced from the reservoir may also be measured downhole in the subsurface 215. A device 643 measuring the flow rate of the CO2 containing gas may be located downhole near the bottomhole 538 of the production well 536. In one or more embodiments, multi-phase flow meters may be used to measure the CO2 containing gas produced in the reservoir downhole near the bottomhole 538 of the production well 536. The amount of gas produced from the production well 536 in the reservoir may be controlled by a choke valve 657. The CO2 separated from the produced formation fluids may be recovered and re-injected into the reservoir for continued EOR or injected into another reservoir for additional CCUS or EOR operations.

In one or more embodiments, the well environment 201 of the carbon measurement and quantification system 200 includes a measurement collection and analysis system 590. The measurement collection and analysis system 590 may receive and record measurements and data from various devices located in the well environment 201 connected to an injection well, observation well, production well, water injection plant, carbon storage plant, and processing plant. In some embodiments, the measurement collection and analysis system 590 may include a computer system configured to log and provide analysis of the measurements and data.

In one or more embodiments, the measurements and data received by the measurement collection and analysis system 590 may be recorded in real-time, and may be available for review or use within seconds, minutes or hours of being recorded (e.g., the measurements are available within 1 hour of the condition being received). In such embodiments, the measurements and data may be referred to as "real-time" measurements and data. Real-time measurements and data may enable an operator to assess a relatively current state of CO2 migration and sequestration in the reservoir.

In addition to recording the measurements, the measurement collection and analysis system 590 may also be part of a control system for controlling EOR or CCUS operations and may include functionality to control valves or measuring devices associated with the injection system 500. The real-time measurements and data may also allow an operator to make real-time decisions regarding the various components of the well environment.

Although the wells of the carbon measurement and quantification system 200 in FIG. 1 shows vertical wells, the configuration of the injection, observation, and production wells itself is not so limited. The configuration of any well may be vertical, approximately vertical, deviated, approximately horizontal, horizontal, and combinations thereof. The wells may also be a multi-lateral, a multi-level, or both. Further, although the carbon measurement and quantification system 200 of FIG. 1 shows evenly spaced wells, the horizontal distance between the observation wells, CO2 injection wells, water injection wells, and production wells may vary.

Figure 2:
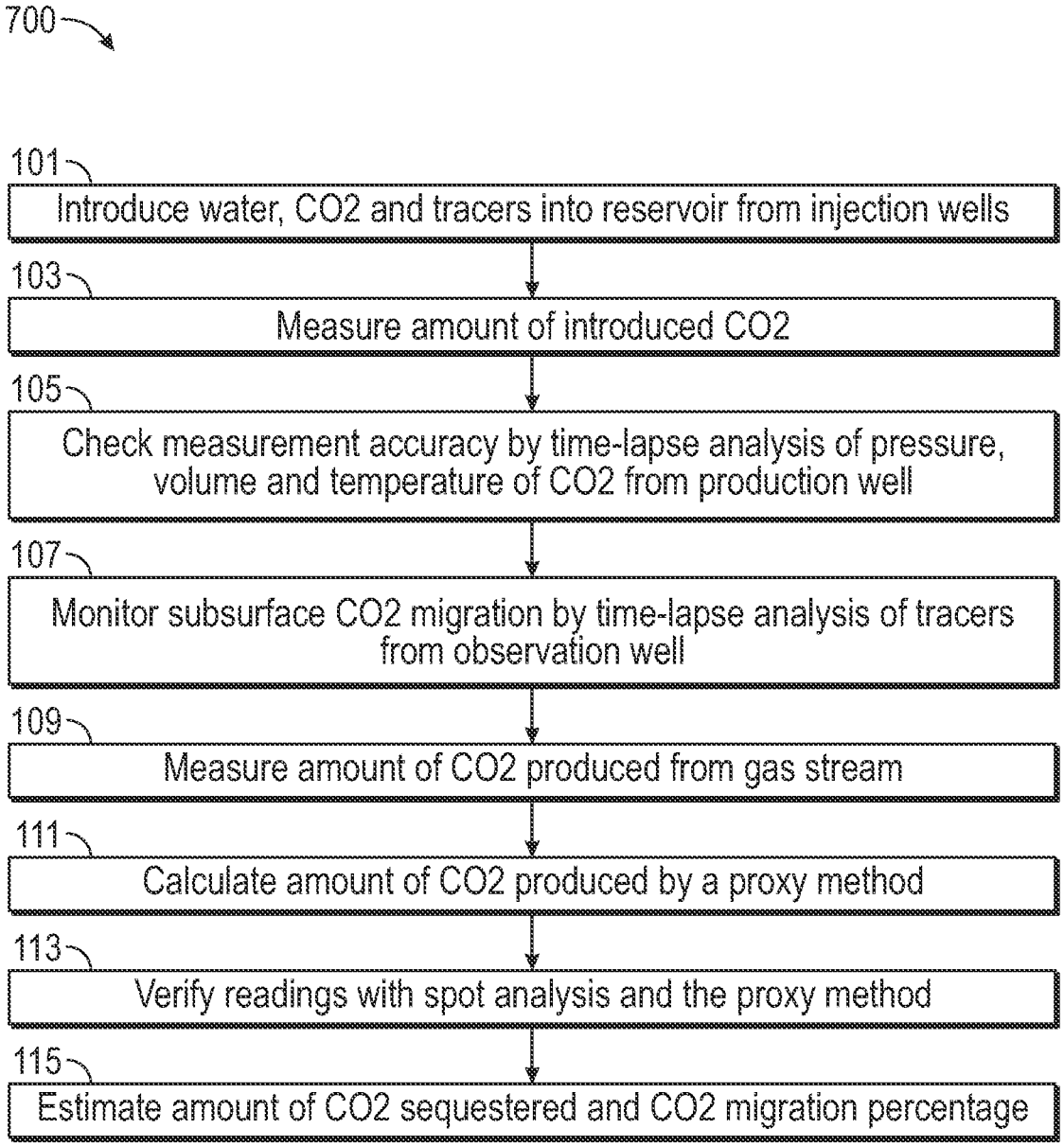
FIG. 2 illustrates a method for monitoring, measuring and quantifying CO2 sequestration according to one or more embodiments.

FIG. 2 illustrates a method of monitoring, measuring and quantifying CO2 sequestration in a reservoir in accordance with one or more embodiments. The method 700 includes introducing CO2, water, and tracers into a reservoir 101. The water from a water injection plant may pass through a flowline and be introduced into a reservoir from an injection well. The CO2 from a CO2 storage plant may pass through a flowline and be introduced into the reservoir from an injection well. The CO2 may contain tracers that are mixed with CO2. In one or more embodiments, the tracers may be mixed with water. Those having skill in the art would appreciate the amount of tracers that are required for a given reservoir. For example, in one or more embodiments around 1 bbl (barrel) of chemical tracer may be mixed with 75,000-10,000 barrels of water per day. In one or more embodiments 1 bbl of gas tracer may be mixed with 30 million standard cubic feet CO2 per day (SCF/day).

The amount of CO2 introduced into the reservoir may be measured 103. In one or more embodiments, the amount of CO2 introduced into the reservoir may be measured at the CO2 storage plant by a device measuring the flow rate of the CO2 entering the CO2 flowline. In one or more embodiments, the device measuring the flow rate is an orifice meter. The amount of CO2 introduced into the reservoir may also be measured in the subsurface where a device measuring the flow rate of the CO2 may be located downhole near the bottomhole of the CO2 injection well. In one or more embodiments, Coriolis meters or ultrasonic meters may be used to measure the CO2 entering the reservoir. The net amount of CO2 injected is measured and logged to give real-time time lapse measurements.

The method 700 may include checking the accuracy of measurements by time-lapse analysis of pressure, volume and temperature of gas from the production well 105. Initially, CO2 is not produced at a production well because the production well may be located some distance away from the injection wells. After some time, CO2 may arrive at a production well where a device measuring the flow rate of the oil and gas may be located downhole near the bottomhole of the CO2 production well such as a multiphase flow meter.

The method 700 may include monitoring subsurface CO2 by real-time, time lapse analysis of tracers from one or more observation wells 107. The observation wells are located some distance away from the CO2 injection wells. The fast appearance of tracer near the overburden may indicate migration and pooling of CO2 near the overburden or leaking CO2 towards the surface. If a leak is detected, the introduction of CO2 in the reservoir may be halted until the issue is resolved.

The method 700 may include measuring CO2 produced from a gas stream 109. Gas rates from gas stream may be measured from production wells. In one or more embodiments, multi-phase flow meters may be used to measure the CO2 containing gas stream produced downhole near the bottomhole of the production well. Gas samples may be measured over time and logged in the measurement collection and analysis system. From the flow rate and composition of the gas, the amount of CO2 can be estimated. In one or more embodiments, the amount of CO2 may be measured in a stream of produced formation fluids passing to a processing plant by a device measuring the amount of the CO2 containing gas entering the flowline from the production well. In one or more embodiments, an orifice meter may be used to measure the CO2 containing oil and gas entering the processing plant. These can be spot analyzed to cross-check the real-time measurements.

The method 700 may also include calculating CO2 produced by a proxy of cumulative oil and gas produced (proxy method) 111. The amount of CO2 sequestered in a reservoir may be calculated and quantified through a material balance of the injected CO2 and produced CO2. In step 111, the amount of oil produced from the production well is measured and multiplied by the original gas to oil ratio. The derived value is an estimation of the total amount of gas produced at the processing plant from production wells. This value is defined as the solution gas. The cumulative gas produced from the production well minus the solution gas gives the cumulative amount of CO2 produced from the production well.

The method 700 may also include using the measurements of CO2 produced from a gas stream 109 and the calculation of CO2 produced by the proxy method 111 for verifying and calibrating the amount of CO2 produced 113.

The method 700 may also include estimating the amount of CO2 sequestered and the CO2 migration percentage 115. The net CO2 retained or stored in the reservoir may be found by calculating the difference of the injected CO2 and the produced CO2.

In one or more embodiments, the method 700 steps may be performed concurrently because measurements and data received from devices of the well injection system are recorded in real-time, and available for review or use within seconds, minutes or hours by the measurement collection and analysis system.

The following example is merely illustrative and should not be interpreted as limiting the scope of the present disclosure.

Figure 3:
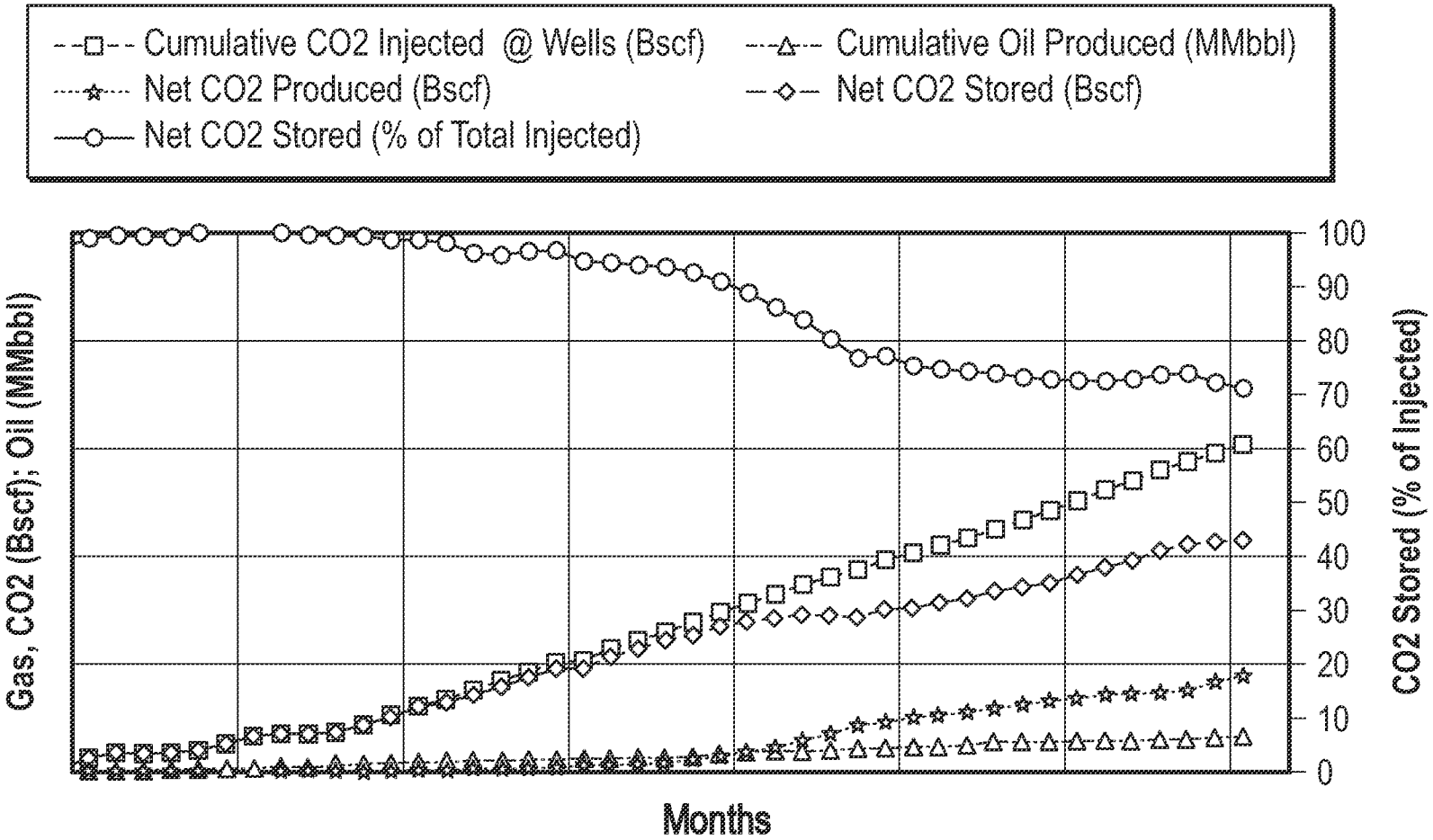
FIG. 3 illustrates a pilot project according to one or more embodiments.

FIG. 3 displays monthly averages of CO2 measurements recorded over a 43 month period. CO2 was introduced as part of an EOR system where oil was produced and measured in million barrels (MMbbl). The CO2 measurements were made at injection wells/carbon storage plant, observation wells, and production wells/GOSP by multiphase flow meters and Coriolis meters. The amount CO2 injected each month was measured in billions of standard cubic feet (Bscf). The amount of CO2 measured may be converted into a percentage (%) of CO2 injected, stored, or produced. CO2 measurements were recorded and used to quantify the amount of CO2 stored or sequestered within the reservoir.

As part of an EOR system, CO2 containing gas was injected from injection wells into the reservoir. For approximately the first 20 months a very little amount of net CO2 was produced from the production wells therefore the initial amount of CO2 stored in the reservoir was around 100%. However, between 21 to 43 months a real-time increase in CO2 production was measured and recorded along with oil production from production wells.

Using the measurements of injected CO2, and the measurements of produced CO2 according to the method described, the net CO2 stored in the reservoir was calculated from the difference of the injected CO2 and the produced CO2 for a given period. In one or more embodiments, the net CO2 stored in the reservoir may be recorded as a percentage of cumulative CO2 injected. The increase in the production of CO2 corresponds to a decrease in CO2 stored in the reservoir. The decrease in CO2 stored in the reservoir results in net CO2 stored in the reservoir decreasing below 100%. For example, at the 43 month period, the net CO2 stored in the reservoir decreased to approximately 70% with respect to the cumulative amount of CO2 injected.

Further, calculated values of CO2 stored in the reservoir may be continuously updated as new measurements are recorded by the measuring devices. The calculated value of CO2 allows for an accurate prediction of the net CO2 stored in the reservoir. The data, measurements and calculations may be provided to operators in a variety of ways to aid in assessing a relatively current state of CO2 migration and sequestration in the depleted reservoir. Not following the process as outlined may lead to inaccurate predictions and overestimations of the net CO2 stored within a reservoir.

Unless defined otherwise, all technical and scientific terms used have the same meaning as commonly understood by one of ordinary skill in the art to which these systems, apparatuses, methods, processes and compositions belong.

The singular forms "a," "an," and "the" include plural referents, unless the context clearly dictates otherwise.

As used here and in the appended claims, the words "comprise," "has," and "include" and all grammatical variations thereof are each intended to have an open, non-limiting meaning that does not exclude additional elements or steps.

"Optionally" means that the subsequently described event or circumstances may or may not occur. The description includes instances where the event or circumstance occurs and instances where it does not occur.

When the word "approximately" or "about" are used, this term may mean that there can be a variance in value of up to ±10%, of up to 5%, of up to 2%, of up to 1%, of up to 0.5%, of up to 0.1%, or up to 0.01%.

Ranges may be expressed as from about one particular value to about another particular value, inclusive. When such a range is expressed, it is to be understood that another embodiment is from the one particular value to the other particular value, along with all particular values and combinations thereof within the range.

While the disclosure includes a limited number of embodiments, those skilled in the art, having benefit of this disclosure, will appreciate that other embodiments may be devised which do not depart from the scope of the present disclosure. Accordingly, the scope should be limited only by the attached claims.

What is claimed as new and desired to be protected by Letters Patent of the United States is:

1. A process for quantifying CO2 sequestration within a reservoir, the process comprising:

measuring a cumulative amount of CO2 injected into a reservoir via one or more injection wells;

measuring a cumulative amount of CO2 produced from the reservoir via one or more production wells;

verifying the cumulative amount of CO2 produced by using a measured amount of CO2 produced from a gas stream from the one or more production wells and a calculated cumulative amount of CO2 produced obtained by a proxy method using a cumulative oil and gas produced, the proxy method determining the calculated cumulative amount of CO2 produced by deriving solution gas from the cumulative oil produced and subtracting the solution gas from the cumulative gas produced;

estimating a cumulative amount of CO2 migrated from a reservoir based on measured CO2 at one or more observations wells;

calculating a net amount of CO2 remaining in the reservoir based on the cumulative amount of CO2 injected, the cumulative amount of CO2 produced, and the cumulative amount of CO2 migrated; and using the calculated net amount of CO2 remaining to estimate CO2 migration percentage.

2. The process of claim 1, wherein measuring the cumulative amount of CO2 injected comprises measuring an amount of CO2 injected into the injection well during enhanced oil recovery.

3. The process of claim 1, wherein measuring the cumulative amount of CO2 injected comprises measuring an amount of CO2 injected into the injection well during drilling operations and measuring an amount of CO2 recovered from a mud gas separator during the drilling operations.

4. The process of claim 1, wherein measuring the cumulative amount of CO2 injected comprises measuring an amount of CO2 provided from a CO2 storage plant to the injection well.

5. The process of claim 1, wherein measuring the cumulative amount of CO2 injected comprises measuring an amount of CO2 provided to a mixing process for preparing an enhanced oil recovery fluids or foam that is then injected into the reservoir via the injection well.

6. The process of claim 1, wherein measuring the cumulative amount of CO2 injected comprises measuring a flow rate of a CO2 mixture injected into the reservoir, measuring a composition of CO2 in the CO2 mixture, and calculating a flow rate of CO2 injected.

7. The process of claim 1, wherein measuring the cumulative amount of CO2 injected comprises measuring the flow rate of the CO2 mixture is performed uphole or is performed downhole within the injection well during injection.

8. The process of claim 1, wherein measuring the cumulative amount of CO2 injected comprises measuring a total gas stream, analyzing the composition of the gas stream, and calculating the CO2 rate.

9. The process of claim 1, wherein measuring the cumulative amount of CO2 produced comprises measuring an amount of CO2 recovered from the production well during enhanced oil recovery.

10. The process of claim 1, wherein measuring the cumulative amount of CO2 produced comprises measuring an amount of CO2 recovered from the production well during drilling operations.

11. The process of claim 1, wherein measuring the cumulative amount of CO2 produced comprises measuring an amount of CO2 provided to a gas oil separation plant from the production well.

12. The process of claim 1, wherein measuring the cumulative amount of CO2 produced comprises measuring the flow rate of the CO2 mixture is performed uphole or is performed downhole within the production well.

13. The process of claim 1, wherein measuring the cumulative amount of CO2 produced comprises measuring a total gas stream, analyzing the composition of the gas stream, and calculating the CO2 rate.

14. The process of claim 1, wherein measuring the cumulative amount of CO2 produced comprises measuring a multiphase stream, analyzing the composition of the multiphase stream, and calculating the CO2 rate.

15. The process of claim 14, wherein the CO2 rate is calculated directly from the multiphase stream or via a proxy of cumulative oil and gas produced.

16. The process of claim 1, further comprising verifying the cumulative amount of CO2 produced via spot analysis.

17. The process of claim 1, wherein estimating the cumulative amount of CO2 migrated comprises measuring an amount of CO2 recovered from the observation well.

18. The process of claim 1, wherein estimating the cumulative amount of CO2 migrated comprises measuring the flow rate of the CO2 mixture is performed uphole or is performed downhole within the observation well.

19. The process of claim 1, wherein estimating the cumulative amount of CO2 migrated comprises measuring a total gas stream, analyzing the composition of the gas stream, and calculating the CO2 rate.

20. The process of claim 1, wherein estimating the cumulative amount of CO2 migrated comprises measuring tracers introduced via the injection well and produced from the reservoir via the observation well.

21. The process of claim 1, wherein measuring the cumulative amount of CO2 comprises measuring the CO2 based on real time measurements.

22. The process of claim 1, wherein measuring the cumulative amount of CO2 comprises measuring the CO2 based on an average or spot data over given time intervals.

23. The process of claim 1, wherein the net amount of CO2 remaining in the reservoir is calculated during an enhanced oil recovery process.

24. The process of claim 1, wherein the net amount of CO2 remaining in the reservoir is calculated over a lifetime of a well.

25. A process for quantifying CO2 sequestration within a reservoir, the process comprising:

measuring a cumulative amount of CO2 injected into a reservoir via one or more injection wells by measuring:

an amount of CO2, from a CO2 storage plant, from a mixing process for preparing an enhanced oil recovery fluids or foam and recovered from a mud gas separator; and a flow rate of an injected CO2 mixture uphole or downhole within the injection well, measuring a composition of CO2 in the mixture, calculating a flow rate of CO2 injected and a total gas stream, analyzing the composition of the gas stream, and calculating the CO2 rate;

measuring a cumulative amount of CO2 recovered from the reservoir via one or more production wells by measuring:

an amount of CO2 from a gas oil separation plant, a flow rate of a produced CO2 mixture uphole or downhole within the production well, a composition of CO2 in the mixture, calculating the flow rate of produced CO2;

a total gas stream, analyzing the composition of the gas stream, and calculating the CO2 rate; and a multiphase stream, analyzing the composition of the multiphase stream, and calculating the CO2 rate;

verifying via spot analysis or a proxy of the cumulative oil and gas produced;

estimating a cumulative amount of CO2 migrated from a reservoir based on measured CO2 at one or more observations wells by measuring:

an amount of CO2 recovered from the observation well, a flow rate of the CO2 mixture uphole or downhole within the observation well, a composition of CO2 in the mixture, calculating a flow rate of CO2 produced, a total gas stream, analyzing the composition of the gas stream, and calculating the CO2 rate; and tracers introduced via the injection well and produced via the observation well;

calculating a net amount of CO2 remaining in the reservoir based on the cumulative amount of CO2 injected, the cumulative amount of CO2 produced, and the cumulative amount of CO2 migrated; and using the calculated net amount of CO2 remaining to estimate CO2 migration percentage or CO2 sequestration percentage during an enhanced oil recovery process or over a lifetime of a well.

26. The process of claim 25, wherein measuring the cumulative amount of CO2 injected comprises measuring an amount of CO2 injected during enhanced oil recovery or during drilling operations.

27. The process of claim 25, wherein measuring the cumulative amount of CO2 produced comprises measuring an amount of CO2 recovered from the production well during enhanced oil recovery or during drilling operations.

28. The process of claim 25, wherein flow rate of CO2 produced is calculated directly from the gas stream or via a proxy of cumulative oil and gas produced.

29. The process of claim 25, wherein measuring the cumulative amount of CO2 comprises measuring the CO2 based on real time measurements, on an average or spot data over given time intervals.

* * * * *